US011622633B2

(12) United States Patent
Liu

(10) Patent No.: US 11,622,633 B2
(45) Date of Patent: Apr. 11, 2023

(54) MULTIFUNCTIONAL MOTION SIMULATION BED

(71) Applicant: Jiahuan Liu, Hayward, CA (US)

(72) Inventor: Jiahuan Liu, Hayward, CA (US)

( * ) Notice: Subject to any disclaimer, the term of this patent is extended or adjusted under 35 U.S.C. 154(b) by 273 days.

(21) Appl. No.: 16/595,465

(22) Filed: Oct. 8, 2019

(65) Prior Publication Data

US 2021/0100366 A1 Apr. 8, 2021

(51) Int. Cl.

| | |
|---|---|
| ***A47C 20/04*** | (2006.01) |
| ***A47C 19/22*** | (2006.01) |
| ***A47C 31/12*** | (2006.01) |
| ***A47C 31/00*** | (2006.01) |

(52) U.S. Cl.

CPC ..... *A47C 20/041* (2013.01); *A47C 19/22* (2013.01); *A47C 31/008* (2013.01); *A47C 31/123* (2013.01)

(58) Field of Classification Search

CPC ..... A47C 20/041; A47C 20/048; A47C 20/08; A47C 19/00; A47C 19/02; A47C 19/22; A47C 31/008; A47C 31/123; A61M 21/02; A61M 2021/0022; A63G 31/00; A61G 7/002; A61G 7/005; A61G 7/015; A61G 7/018

See application file for complete search history.

(56) References Cited

U.S. PATENT DOCUMENTS 1,037,419 A * 9/1912 Bosankowj ..... A61G 7/005 5/610
4,675,926 A * 6/1987 Lindblom ..... A47C 19/045 5/611
5,461,740 A * 10/1995 Pearson ..... A61G 7/012 5/607
5,568,661 A * 10/1996 Bathrick ..... A47C 20/041 5/285
5,940,911 A * 8/1999 Wang ..... A47C 21/006 5/610
6,360,386 B1 * 3/2002 Chuang ..... A61G 7/001 5/607
6,851,144 B2 * 2/2005 Wang ..... A61G 7/015 5/109
6,868,567 B2 * 3/2005 Edgerton ..... A61G 7/015 5/600

(Continued)

FOREIGN PATENT DOCUMENTS

CN 109393815 A * 3/2019

*Primary Examiner* — David R Hare

(74) *Attorney, Agent, or Firm* — Jigang Jin

(57) ABSTRACT

The present invention discloses a multifunctional motion simulation bed which has multiple segments and simulates preprogrammed motions. The segments are articulately connected to form a motion platform. In one embodiment, the segments are disposed above a base. Actuators are mounted on the base and pivotally coupled with the base and the segments. A microprocessor drives the actuators individually and causes the motion platform to simulate motions. In another embodiment, the segments are disposed above a frame which is arranged above a base. One segment is fixed on the frame. Some actuators are pivotally coupled with the frame and some of the segments. Other actuators are pivotally coupled with the frame and the base. A microprocessor drives the actuators individually and causes the frame and motion platform to simulate motions.

6 Claims, 5 Drawing Sheets

(56) References Cited

U.S. PATENT DOCUMENTS

| | | | | |
|---|---|---|---|---|
| 8,056,164 | B2 * | 11/2011 | Benzo | A61G 7/0573 5/613 |
| 8,800,080 | B2 * | 8/2014 | Kay | A61G 7/005 5/618 |
| 9,808,093 | B2 * | 11/2017 | Rawls-Meehan | A47C 20/04 |
| 2005/0166323 | A1 * | 8/2005 | Kawakami | A61G 7/001 5/610 |
| 2006/0026764 | A1 * | 2/2006 | Mossbeck | A61G 7/018 5/618 |
| 2006/0085913 | A1 * | 4/2006 | Kawakami | A47C 20/041 5/618 |
| 2008/0127419 | A1 * | 6/2008 | Jensen | A61G 7/018 5/616 |
| 2008/0262657 | A1 * | 10/2008 | Howell | A47C 31/008 700/275 |
| 2008/0276373 | A1 * | 11/2008 | Clenet | A47C 20/08 5/618 |
| 2009/0089930 | A1 * | 4/2009 | Benzo | A61G 7/015 5/613 |
| 2011/0138536 | A1 * | 6/2011 | Wernqvist | A61G 7/002 5/618 |
| 2013/0160209 | A1 * | 6/2013 | Turner | A61G 7/07 5/618 |
| 2014/0325759 | A1 * | 11/2014 | Bly | A61G 7/015 5/611 |
| 2015/0121623 | A1 * | 5/2015 | Huang | A61G 7/018 5/616 |
| 2018/0116885 | A1 * | 5/2018 | St. John | A61G 7/005 |
| 2019/0142667 | A1 * | 5/2019 | Paul | A61G 7/018 5/600 |

* cited by examiner

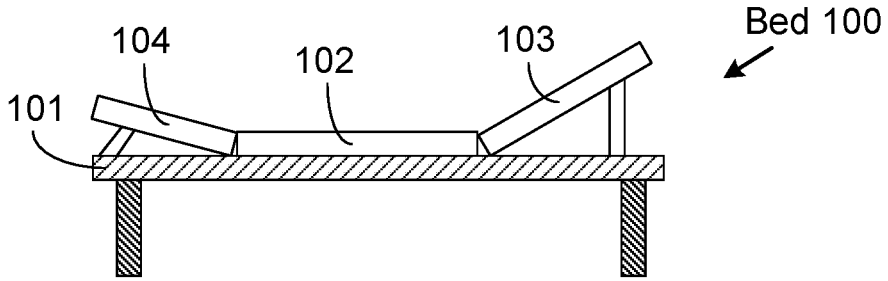
FIG. 1 (Prior Art)
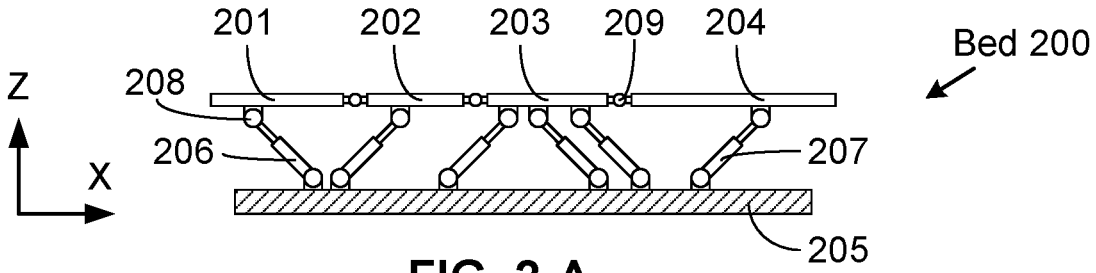
FIG. 2-A
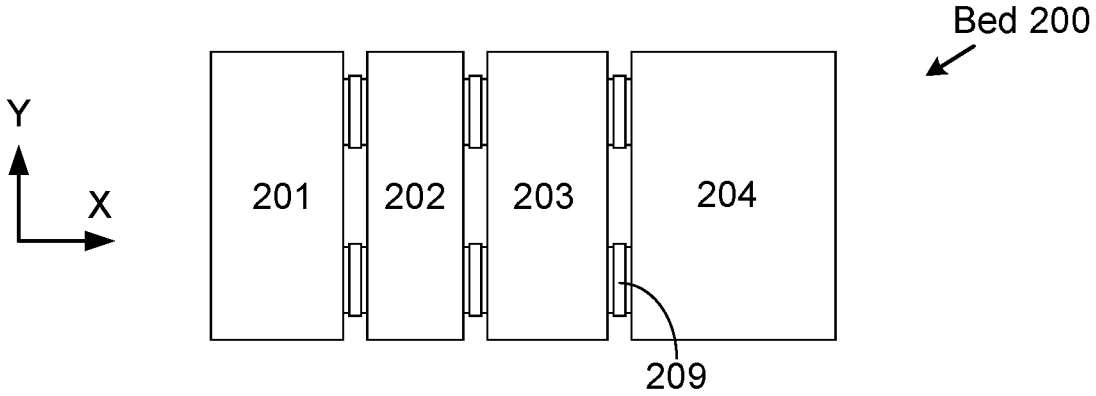
FIG. 2-B
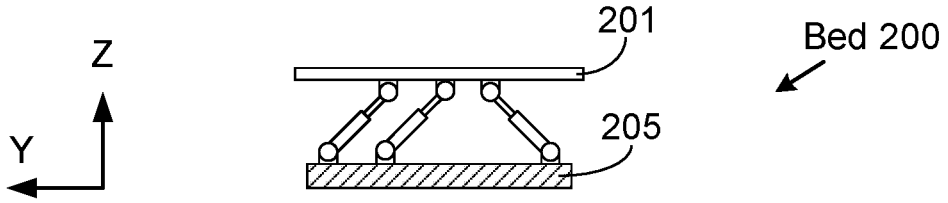
FIG. 2-C

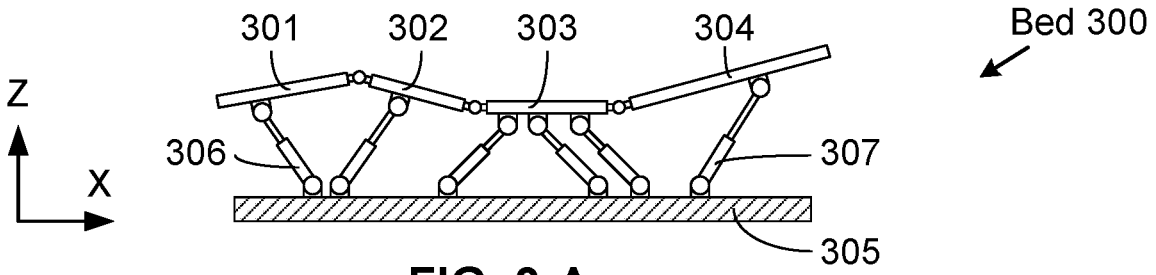
FIG. 3-A
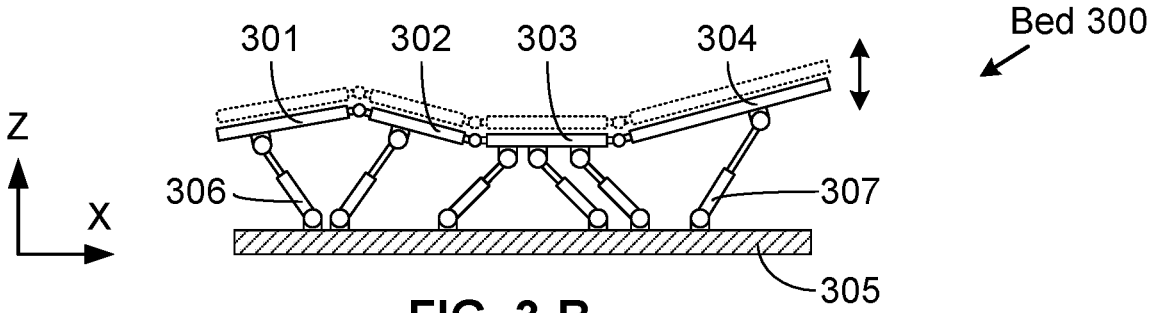
FIG. 3-B
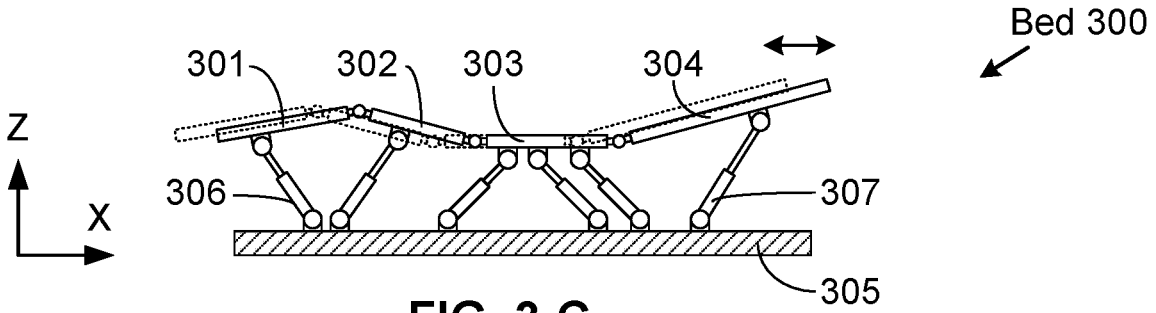
FIG. 3-C
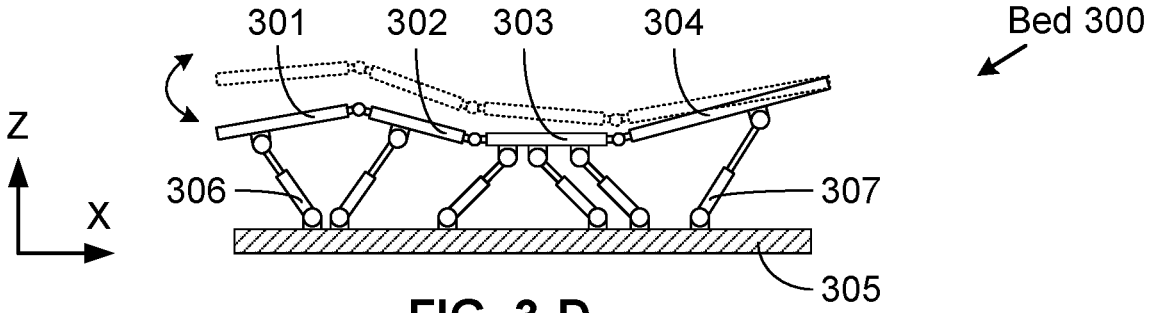
FIG. 3-D

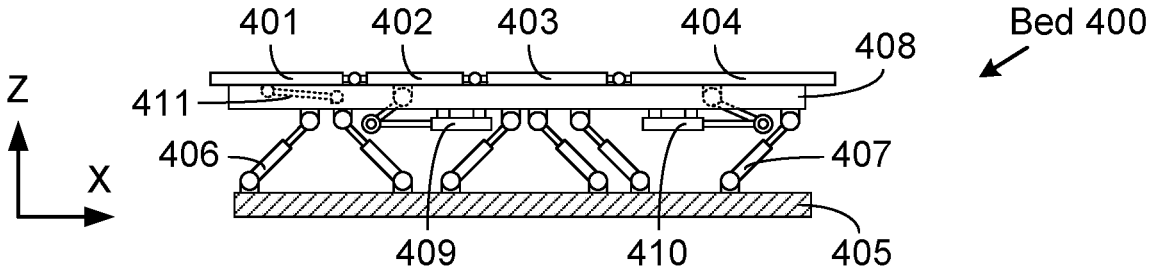
FIG. 4-A
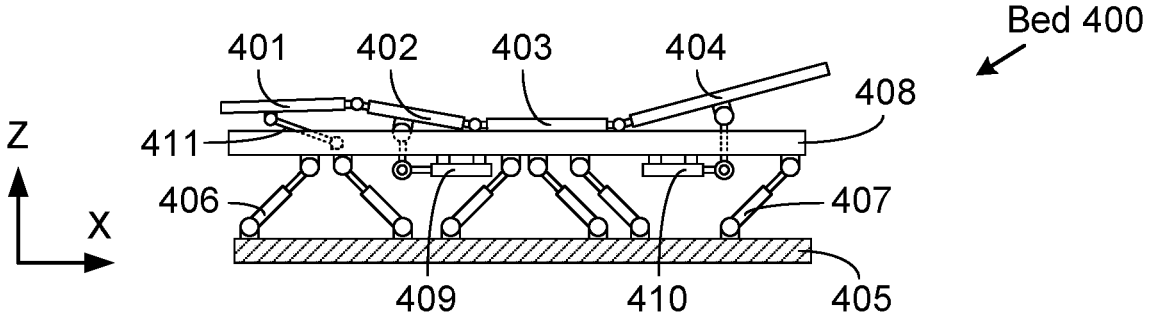
FIG. 4-B
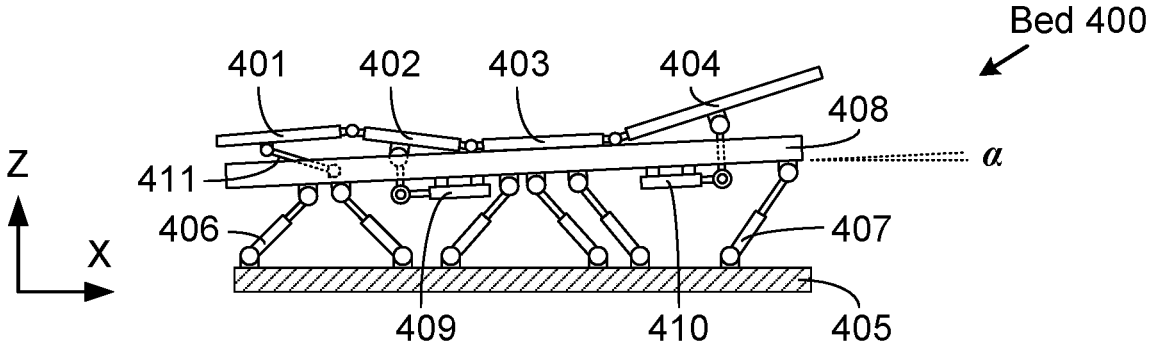
FIG. 4-C

MULTIFUNCTIONAL MOTION SIMULATION BED

FIELD OF INVENTION

This invention generally relates to a multifunctional motion simulation bed and specifically to a multifunctional motion simulation bed with adjustable position for purposes of pleasure and benefits for sleep disorders.

BACKGROUND OF THE INVENTION

A traditional bed usually comprises a frame and a mattress. The mattress rests flatly on the frame. Some traditional beds are made adjustable for the comfort of a person. For instance, FIG. 1 shows a prior-art bed 100 which has a frame 101, a stationary section 102, an adjustable head section 103, and an adjustable foot section 104. The head and foot sections may be articulated separately for different position settings. The setting of a traditional adjustable bed may be changed manually, electrically, or automatically. In the latter case, microelectronic and automation technologies are used. For instance, a traditional bed may be changed from one setting to another automatically after a control button is pushed.

A traditional adjustable bed may satisfy the needs of some people. However, the bed usually remains stationary and lacks capabilities to simulate motions. Certain motions may generate specific physiological stimulation. The stimulation in turn produces a sensation which a person may desire. For instance, when a person wants to fall asleep, the person may like to experience the movement of a floating buoy or a moored ship in a quiet sea. When a person is happy and relaxed, the person may like to experience the movement of a swing, as swinging creates a euphoric sensation of floating up in the air. As recent research has shown, whole-night continuous rocking entrains spontaneous neural oscillations with benefits for sleep and memory. But traditional beds or adjustable beds don't provide such motion functions.

Therefore, there exists a need for a bed which simulates certain motions. The motions may be preprogrammed and give a person desired sensations for the purpose of sleep, relaxation, or entertainment.

SUMMARY OF THE INVENTION

The present invention discloses a multifunctional motion simulation bed having motion capabilities with adjustable position. The bed is adjustable for different contours or positions and operable for simulating a number of predefined motions. The combination of a select contour or position and a chosen motion (including self-defined motions and customized motions with specific purposes) may provide a remedy for a person suffering from insomnia, apnea syndrome, snore, acid reflux, back problem, muscle sore, etc. It may also provide a facility for relaxation, entertainment, and rehabilitation.

For aforesaid objectives, a bed is configured as follows.

The bed is designed to provide a motion platform which has an adjustable contour, provides different positions, and simulates certain movements. The bed includes:

a stationary base;

multiple segments which are connected articulately to form a motion platform;

multiple actuators mounted on the base which carry and move the segments individually; and a processor which controls the actuators to maintain a contour of the motion platform and cause the motion platform to simulate motions.

Optionally, the bed comprises four segments. A middle segment is supported by three actuators. The rest segments each are supported by one actuator.

Optionally, the bed comprises four segments. A middle segment is supported by six actuators. The rest segments each are supported by one actuator.

Optionally, the motion platform simulates six degree of freedom (DOF) motions.

Optionally, sensors are disposed to monitor the operation of the actuators and performance of the motion platform.

Alternatively, the bed may have another structure. The bed includes:

a stationary base;

a frame disposed above the base;

multiple segments which are based on the frame and connected articulately to form a motion platform;

multiple actuators which drive some of the segments;

additional actuators which are disposed on the base to carry and move the frame; and a processor which controls the actuators to maintain a contour of the motion platform and cause the frame and the motion platform to simulate motions.

Optionally, the bed comprises four segments. A middle segment is mounted on the frame. A foot segment is supported by a connection rod.

Optionally, six actuators are disposed on the base to support and manipulate the frame.

Optionally, the frame and motion platform simulate six DOF motions.

Optionally, sensors are disposed to monitor the operation of the actuators and performance of the frame and motion platform.

Therefore, a multifunctional motion simulation bed is proposed which simulates motions and provide adjustable contours or positions. The bed may provide various contour shapes, positions, and simulated motions. For a person, experience of the motions may calm nerves, subdue feelings, relieve certain pain, benefit sleep and memory, or be a fun and relaxing thing to do.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings. Additionally, the leftmost digit of a reference number identifies the drawing in which the reference number first appears.

FIG. 1 illustrates a prior-art adjustable bed.

FIGS. 2-A, 2-B, and 2-C respectively illustrate a front view, a top view, and a side view of an exemplary multifunctional motion simulation bed with a motion platform, according to one embodiment of the present invention.

FIGS. 3-A, 3-B, 3-C, and 3-D respectively illustrate four front views of an exemplary multifunctional motion simulation bed with a motion platform, according to one embodiment of the present invention.

FIGS. 4-A, 4-B, and 4-C illustrate three front views of an exemplary multifunctional motion simulation bed with a motion platform, according to one embodiment of the present invention.

DETAILED DESCRIPTION

Figure 5:
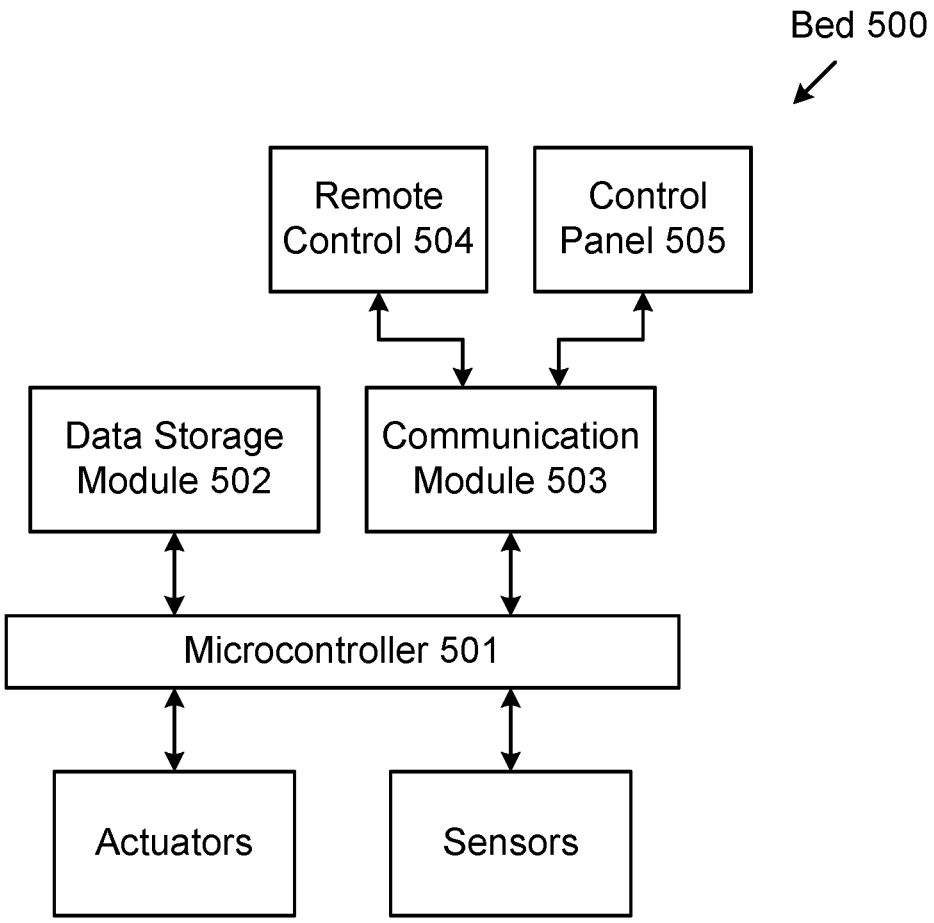
FIG. 5 is a diagram showing an exemplary configuration of a multifunctional motion simulation bed with a motion platform, according to one embodiment of the present invention.

Detailed description of the present invention is provided below along with figures and embodiments, which further clarifies the objectives, technical solutions, and advantages of the present invention. It is noted that schematic embodiments discussed herein are merely for illustrating the invention. The present invention is not limited to the embodiments disclosed.

FIG. 2-A illustrates an exemplary multifunctional motion simulation bed 200 with a motion platform in a front view in the X-Z plane, according to one embodiment of the present invention. Bed 200 is built on a stationary base 205 and comprises a foot segment 201, a head segment 204, and two middle segments 202 and 203. The segments are connected together articulately to form a motion platform. Between the segments and base 205, actuators, such as actuators 206 and 207, are disposed for supporting and manipulating the segments. Synchronous movement of the actuators causes the motion platform to simulate a motion. Thus, when a person lies on bed 200, the bed may move to simulate a motion while supporting the person with different positions and giving him or her certain sensations. The motions may include movements of a mooring ship, a swing, or customized movements for specific purposes, etc. The person may select one motion and/or one position and issue an order to the bed via a controlling device (e.g., a smartphone having a control application).

Back to the figure. The upper surfaces of the segments represent a contour of the motion platform. When orientation of some segments is changed, the contour is changed, providing various positions for a person. Thus, the contour may be adjusted by the actuators. The segments and the base may have the same or different materials and may be constructed from one or more materials that include wood, metal, plastics, polymers, and composite materials. Optionally, the upper surfaces of the segments may be covered with skirting, panels, upholstery, and/or padding. When the bed is in use, a soft mattress or any adjustable base compatible mattress (not shown may be placed on the segments.

The actuators are linear actuators, which may include electric actuators, pneumatic actuators, hydraulic actuators, or other linear actuators. The actuators are pivotally coupled with base 205 and the segments respectively. For instance, an upper end of actuator 206 is pivotally coupled to segment 201 via a spherical bearing 208 and a lower end of the actuator is pivotally coupled to base 205 via another spherical bearing positioned at the base. The spherical bearings are configured such that they allow the actuator to rotate freely. The spherical bearings may be replaced by other spherical connectors which enable pivotal coupling of the actuators with the segments and base 205.

As shown in FIG. 2-A, actuator 206 may have an actuator body and an actuator rod. The actuator rod may be supported within a channel (not shown) of the actuator body and moved within the channel in a selective manner. For instance, the actuator rod may be extended outward from or withdrawn into the actuator body. When the actuator rod is driven outward from the actuator body, it pivotally pushes segment 201 upward. When the actuator rod is pushed inward or into the actuator body, it pivotally pulls segment 201 downward.

Segments 201, 202, 203, and 204 are articulately coupled to form a motion platform. In one embodiment, a coupling component 209 and other identical coupling components bind the segments articulately. Because of the articulation function of the coupling component, the segments are always kept together, showing the contour of the platform.

FIG. 2-B exemplarily illustrates bed 200 in a top view in the X-Y plane. One segment is connected to another segment by two coupling components. The coupling components may be a hinge-like device, for instance. More than two coupling components may be used for the articulation of two segments. When one segment is moved, it exerts a force to its neighboring segment or segments through the coupling components.

FIG. 2-C exemplarily illustrates bed 200 in a side view in the Y-Z plane. The figure shows segment 201, base 205, and some (but not all) actuators in a schematic manner. The quantity, orientation, and positions of the actuators in the figure are chosen for illustration purpose only.

Returning to FIG. 2-A. Each of the segments is supported and driven by one or more actuators. In one embodiment, segment 203 is supported by three actuators and the other three segments each are supported by only one actuator. Alternatively, segment 203 may be supported by more than three actuators, such as six or eight of them. Also alternatively, segments 201, 202, and 204 may be supported by two or more than two actuators. In this and other figures, the orientation or gestures of the actuators are for illustration purpose only.

When the actuators are driven to extend or withdraw the actuator rods in a predefined way, the segments change orientation and positions, as illustrated exemplarily in FIG. 3-A in a front view in the X-Z plane, according to one embodiment of the present invention. As used herein, position of a segment is the position of the segment's center of gravity. And orientation of a segment represents tilting angles with regard to the X, Y, and Y axes. In the figure, a multifunctional motion simulation bed 300 resembles bed 200 and may have identical structure, components, and materials. Bed 300 may comprise segments 301, 302, 303, and 304, a stationary base 305, and actuators including actuators 306 and 307. The segments form a motion platform. The upper surfaces of the segments represent a contour of the motion platform.

In one embodiment, bed 300 has six actuators, where segment 303 is supported by three actuators and the other segments each are supported by only one actuator. Optionally, the segments each may be coupled with more than one actuator. Like bed 200, each actuator of bed 300 is coupled to a segment and the base pivotally via two spherical bearings. As shown in the figure, when an actuator rod is extended outward, it drives a segment to a higher position. As each segment is also coupled to one or two neighboring segments articulately, position and orientation of a segment is determined by one or more actuators coupled to it and one or two neighboring segments. For instance, the position and orientation of segment 303 is determined by the three actuators pivotally coupled to its lower surface and the positions and orientation of segments 302 and 304. Thus, the status of bed 300, i.e., the shape of the contour and movements of the motion platform, is dependent on all actuators.

The six actuators of bed 300 are also responsible for providing controllability and stability of the motion platform. As an actuator needs two spherical bearings, there are totally twelve spherical bearings. Positions of the twelve bearings are selected such that the actuators may manipulate the platform while keeping the platform stable for various orientation configurations.

The six actuators of bed 300 are used to drive the segments individually and synchronously so that the motion platform may simulate movements in three-dimensional (3D) space. With a given software or program, the actuators may cause the segments, i.e., the motion platform, to simulate six DOF motions. For instance, with programmed actuation, the motion platform may move forward or backward on the Y axis, upward or downward on the Z axis, left or right on the X axis, and rotate about the three perpendicular axes.

FIGS. 3-B, 3-C, and 3-D illustrate exemplarily different motions of bed 300 in front views in the X-Z plane. In FIG. 3-B, the motion platform is moved on the Z-axis. The segments in solid and dotted lines depict two positions due to translation motions on the axis. In FIG. 3-C, the motion platform is moved on the X-axis. The segments in solid and dotted lines depict two positions due to translation motions on the axis. In FIG. 3-D, the motion platform is rotated round the Y-axis. The segments in solid and dotted lines depict two positions due to the rotation.

The actuators of bed 300 are used to control the movement of the motion platform. When the platform moves, its contour may remain the same. Optionally, actuators may be adjusted such that the contour of the motion platform may change from one shape to another shape when the platform is in motion. Thus, when a person lies on bed 300, the positioning of the bed or the positioning of the person may remain unchanged or may be changed during a movement period. When the positioning is changed from one setting to another setting, the speed of change should be slow to avoid a feeling of sudden move.

Optionally, bed 300 may have less or more than four segments to support the motion platform. The bed may have the same structure, but the quantity of segments may differ. For instance, the bed may comprise two segments and/or less than six actuators in total. The bed may also comprise five segments, where a middle segment may have at least three actuators and the other segments may have one or more actuators.

FIG. 4-A illustrates an exemplary multifunctional motion simulation bed 400 with a motion platform in a front view in the X-Z plane, according to one embodiment of the present invention. Bed 400 is built on a stationary base 405 and comprises a foot segment 401, a head segment 404, and two middle segments 402 and 403. The segments are connected together articulately to form a motion platform. A frame 408 is arranged between the segments and base 405. Some actuators, such as actuators 406 and 407, are disposed for supporting and manipulating frame 408. Other actuators, i.e., actuators 409 and 410, and a connection rod 411 are configured for supporting and manipulating segments 402, 404, and 401. Connection rod 411 and some sections of actuators 409 and 410 are blocked by frame 408 in the front view and are depicted in dotted lines. Segment 403 is fixed on frame 408 and so the motion platform and the frame move together. Thus, movements of the motion platform are controlled by actuators which are mounted on base 405 and coupled to frame 408.

Like aforementioned embodiments, upper surfaces of the segments represent a contour of the motion platform. The contour may be adjusted by actuators 409 and/or 410. The segments, frame 408, and base 405 may have the same or different materials and may be constructed from one or more materials that include wood, metal, plastics, polymers, and composite materials. Optionally, the upper surfaces of the segments may be covered with skirting, panels, upholstery, and/or padding. Similar to bed 200, a soft mattress or any adjustable base compatible mattress (not shown) may be placed on the segments when bed 400 is in use.

Bed 400 may have the same type of linear actuators as bed 200. Six actuators are pivotally coupled to base 405 and frame 408. For instance, an upper end of actuator 406 is pivotally coupled with frame 408 via a spherical bearing and a lower end of the actuator is pivotally coupled with base 405 via another spherical bearing. The spherical bearing allows an actuator to rotate around it freely. There are twelve spherical bearings for the six actuators. Positions of the spherical bearings are chosen such that the actuators enable stable gestures as well as six DOF motions of the frame. Optionally, less than or more than 6 actuators may be mounted on the base to support and drive frame 408.

Segments 401, 402, 403, and 404 are disposed above and based on frame 408. The segments are articulately connected. Segment 403 is attached on frame 408. Segments 402 and 404 are each pivotally coupled with a connection bar which is articulately coupled to an actuator, i.e., actuator 409 or 410. Segment 401 is pivotally coupled to a single rod, connection rod 411. The contour of the motion platform is controlled by actuators 409 and 410. The platform is carried by frame 408 and moves with it.

FIG. 4-B illustrates bed 400 in another front view in the X-Z plane, according to one embodiment of the present invention. Compared to FIG. 4-A, the contour of the motion platform is changed by actuators 409 and 410. Actuators 409 and 410 are mounted on frame 408. Take actuator 409 for example. Its body is fixed on the lower surface of frame 408 and the outer end of its actuator rod is articulately coupled to a connection bar. The connection bar is coupled to segment 402 pivotally through a bearing device. Alternatively, actuator 409 may be pivotally coupled to segment 402 directly, meaning the connection bar is no longer in need. Similarly, actuator 410 may be pivotally coupled to segment 404 directly as well. Alternatively, actuators 409 and 410 may be mounted on the lower surface of segment 403 to provide identical functions.

The bearing device may be a spherical bearing which allows the connection bar to rotate around it freely. The bearing device may also have another structure and allow the connection bar to rotate only around the Y-axis.

When the actuator rod of actuator 409 is extended outward or withdrawn, it pulls or pushes the connection bar. The connection bar then acts on segment 402 pivotally. Actuator 410 manipulates segment 404 in the same manner.

Connection rod 411 may be coupled to segment 401 and frame 408 with the same bearing devices. Rod 411 may have a fixed length. It holds segment 401 and causes segment 401 to move with a tether when the segment is pulled by its neighbor, segment 402.

Optionally, more than one connection rod may be pivotally coupled to segment 401 to support the segment. In addition, connection rod 411 may be replaced by an actuator. The actuator enables more orientation and position configurations for segment 401. Additionally, segments 402 and 404 may be supported by more than one actuator to enhance stability and reliability.

The movement of the motion platform is driven by actuators disposed between frame 408 and base 405. When the platform is in motion, its contour may remain the same shape or be changed using actuators 409 and 410. The motion platform or frame 408 may be manipulated to simulate six DOF motions, i.e., bed 400 may provide a wide variety of motions when a person lies on it. Preconfigured motions may include movements of a mooring boat, a swing, etc. A person or person may select one motion and issue an order to the bed via a controlling device (e.g., a smartphone having a control application). For instance in FIG. 4-C, the platform is rotated by an angle alpha around the Y-axis, as illustrated exemplarily in a front view in the X-Z plane. The platform may also rotate about other axes, travel along the X-axis, Y-axis, and/or Z-axis, or perform combination of rotation plus translation.

Optionally, bed 400 may have less or more than four segments of the motion platform. The bed may have the same structure, but the quantity of segments differs. For instance, instead of four segments, the bed may comprise two segments, a foot segment attached to frame 408 and a head segment adjustable by an actuator. Bed 400 may also comprise five segments, where a middle segment is mounted on frame 408 and the rest segments are coupled to an actuator or a connection rod pivotally.

When a person lies on bed 400, the contour of the platform, i.e., the positioning of the bed or the positioning of the person may remain unchanged or may be changed during a movement period. When the positioning is changed from one setting to another setting, the speed of change should be slow to avoid a feeling of sudden move.

FIG. 5 is an exemplary block diagram reflecting a structure of a multifunctional motion simulation bed 500. Bed 500 may comprise multiple segments forming a motion platform (not shown), a stationary base (not shown), a microprocessor or microcontroller 501, a data storage module 502, a communication module 503, a remote control 504, a control panel 505, actuators, and sensors installed at bed 500. Microcontroller 501 controls the actuators and manages the sensors. The actuators are used to manipulate the motion platform.

The sensors may include detectors which monitor the status of the actuators, for instance, the position of an actuator rod. The sensors may also include accelerometers and 1-axis or 3-axis gyroscope sensors. The accelerometers and gyros may be mounted on each segment to measure acceleration and rotation values. Movements of the segments may also be detected by optical sensors, such as one or more cameras. The cameras may be placed, for instance, on the base.

Data storage module 502 stores software or applications installed at a control system of bed 500. The software may include motion programs designed for driving the actuators. The motion programs contain sets of instructions which may be implemented by microcontroller 501 to cause the motion platform to simulate six DOF movements. A motion program may be created using certain simulation software. The simulation software may determine movements of the actuator rods according to the required positions and orientation of the segments. Data storage module 502 may also store measurement results and performance data obtained from the sensors. The storage module may include volatile memory such as RAM and non-volatile memory such as flash memory plus storage devices such as hard drives.

Communication module 503 may include a network interface. Via module 503, microcontroller 501 may communicate with a remote server via the Internet. For instance, updated or new programs may be downloaded from the remote server to improve performance of the bed. Microcontroller 501 may also communicate with remote control 504 and control panel 505 through module 503.

Remote control 504 and control panel 505 are controlling devices which allow a person to select a contour of the platform and a motion which is prearranged. The remote control may be a portable gadget with a keypad (e.g., a smartphone with control application). The control panel may be mounted on a headboard of the bed. The two controlling devices may also be connected to microcontroller 501 directly.

Figure 6:
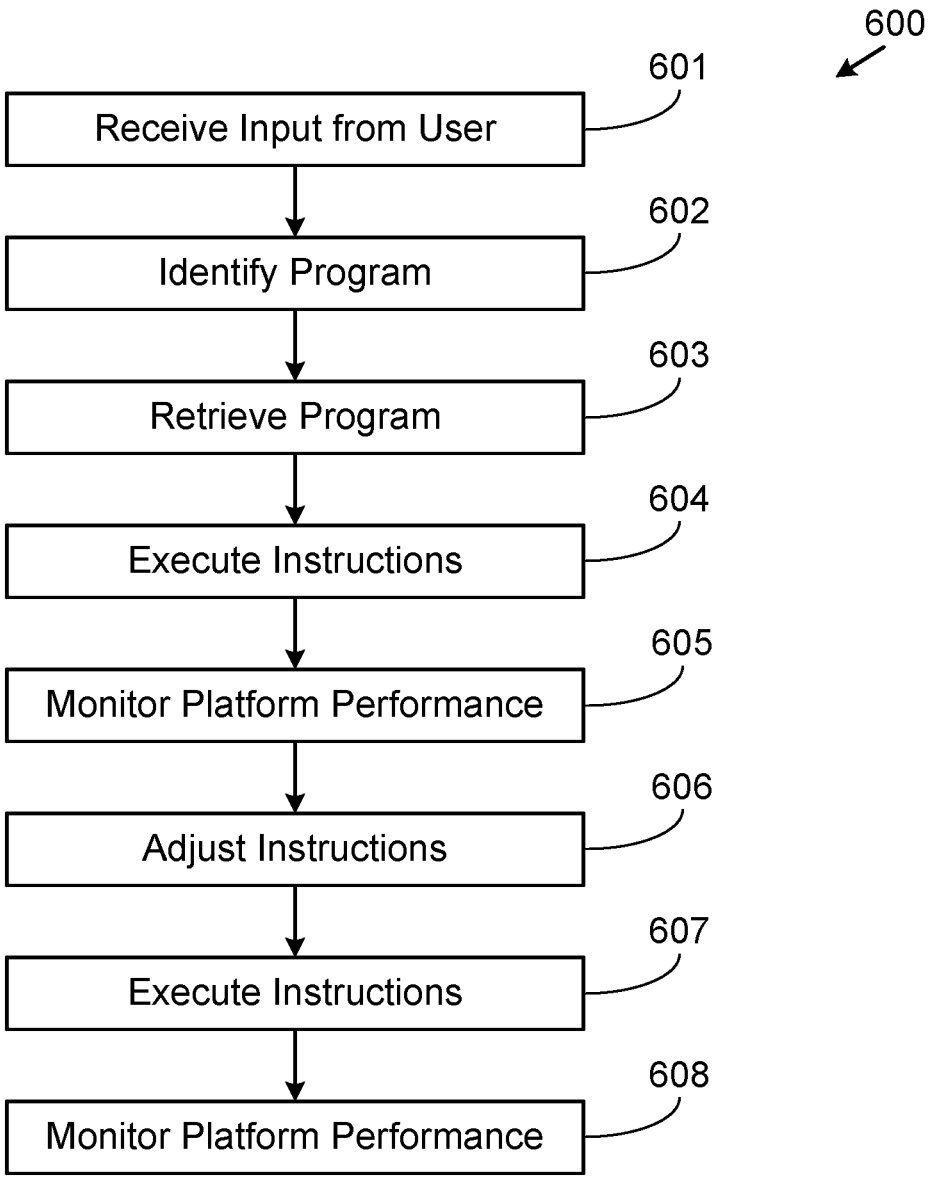
FIG. 6 is a flow diagram that illustrates an exemplary process of operating a multifunctional motion simulation bed with a motion platform, according to one embodiment of the present invention.

FIG. 6 illustrates a flow diagram of a process 600 for a multifunctional motion simulation bed, according to one embodiment of the present invention. Assume that the bed comprises four segments, six or nine actuators, a microprocessor, and a remote control, among other components and parts. The segments form a motion platform. Upper surfaces of the segments represent a contour of the platform. In step 601, a person, while lying on the bed, pushes a button on the remote control to choose a motion after reviewing a list of preset actions. The preset actions may include floating on a lake, swinging along one direction, swinging along another direction, shaking along a chosen direction, a customized motion for specific purpose, and so on.

Push of the button represents submission of an order for the bed to simulate the select motion. Before pressing the button, the person may choose a contour of the motion platform and determine whether the contour should change during the course. The contour of the motion platform determines the positioning of the person. The person may also set an intensity level for the select motion. A higher intensity level means a quicker and more vigorous movement. The microprocessor receives the order and starts an implementation process. First, it identifies a corresponding program in step 602. In step 603, it retrieves the identified program from a hard drive. Next it executes instructions obtained from the program in step 604 and begins simulating the select motion.

After the instructions are implemented, performance of the actuators and movement of the segments are monitored by the microprocessor in step 605. Measurement data is recorded in the hard drive. The microprocessor compares the measurement data with target values and makes adjustments to fine tune the instructions in step 606. Next in step 607, it executes the revised instructions and detects and analyzes the performance of the actuators and segments again in step 608. The instructions may be fine tuned more times if the performance deviation is still beyond a threshold value. When the deviation is within a certain range, the microprocessor may execute the revised instructions and keep doing it for a given time period.

Optionally, a gadget or portable electronic device may be designed. The portable device may comprise motion and positioning sensors such as one or more accelerometers, 1-axis or 3-axis gyroscope sensors, and/or an electronic compass. The device may use the sensors to measure acceleration, rotation, and positioning, which reflect the motion a person experiences. The device then records measurement results along a timeline. For instance, a person may turn on the device before a trip and let it collect and store related motion information. The motion information may include data obtained from the accelerometers, gyros, and the electronic compass and the time of measurement. When the person goes to places sitting in a bus, on a train, and in a boat, different characteristics of movement are recorded in different periods of time. The person may upload the data to a control system of a bed later on. Next the person may select a time period and request the bed to simulate a motion corresponding to the time period. The control system may retrieve and analyze measurement data accordingly. After a motion pattern is calculated using the measurement data and an algorithm, the control system may cause the bed to simulate the motion pattern. Optionally, as a smartphone may carry accelerometers, gyros, and/or an electronic compass, a program or app may be created. A person may install the app at a smartphone. Once the app is started, it may collect and store movement data of the phone continuously and transmit the data to a bed upon request.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

I claim:

1. A bed, comprising:

a base;

a plurality of first actuators mounted on the base;

a movable frame supported and driven by the plurality of first actuators;

a memory for storing preprogrammed instructions;

a plurality of segments mounted on the movable frame, wherein each segment is articulately coupled to another segment, at least one segment is supported and driven by a second actuator mounted on the movable frame, and another of the plurality of segments is coupled to a supporting element mounted on the movable frame; and a processor that controls the plurality of first actuators to move the movable frame according to the preprogrammed instructions stored in the memory so that the movable frame is able to make a movement of six degrees of freedom while simultaneously controls the second actuator to adjust a contour formed by upper surfaces of the plurality of segments.

2. The bed of claim 1, wherein the movable frame is moved by the processor to simulate a motion including repeated swing movements, repeated shaking movements, or repeated movements with an intensity level set by a person.

3. The bed of claim 1 further including a remote control and/or a control panel for a person to select a motion of the movable frame.

4. The bed of claim 1, wherein a third one of the plurality of segments is supported and driven by a third actuator mounted on the movable frame.

5. The bed of claim 1, wherein the movable frame is supported and driven by at least six of the plurality of first actuators.

6. The bed of claim 1, wherein the plurality of first actuators is pivotally coupled with the movable frame and the base.

* * * * *